US007017562B2

(12) United States Patent
Jeon

(10) Patent No.: US 7,017,562 B2
(45) Date of Patent: Mar. 28, 2006

(54) AIR INTAKE SYSTEM FOR A VEHICLE

(75) Inventor: Yong Joo Jeon, Hwaseong (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 11/024,834

(22) Filed: Dec. 28, 2004

(65) Prior Publication Data

US 2006/0005820 A1 Jan. 12, 2006

(30) Foreign Application Priority Data

Jul. 6, 2004 (KR) ..... 10-2004-0052440

(51) Int. Cl.
*F02B 75/18* (2006.01)

(52) U.S. Cl. ..... 123/572; 123/184.24

(58) Field of Classification Search ..... 123/572–574, 123/184.21–18, 184.24, 184.34, 184.42, 123/184.47

See application file for complete search history.

(56) References Cited

U.S. PATENT DOCUMENTS 4,715,329 A * 12/1987 Yasuda et al. ..... 123/184.49
4,741,295 A * 5/1988 Hosoya et al. ..... 123/184.31
4,782,797 A * 11/1988 Kurahashi ..... 123/184.35
4,811,697 A * 3/1989 Kurahashi ..... 123/184.35
4,993,375 A * 2/1991 Akihiko ..... 123/90.38
5,794,602 A * 8/1998 Kimura ..... 123/572
6,092,498 A * 7/2000 Lohr et al. ..... 123/90.38
6,192,848 B1 * 2/2001 Hada et al. ..... 123/184.24
6,772,744 B1 * 8/2004 Nanno et al. ..... 123/572
6,807,957 B1 * 10/2004 Ko ..... 123/572

* cited by examiner

*Primary Examiner*—Marguerite McMahon
(74) *Attorney, Agent, or Firm*—Morgan Lewis & Bockius LLP

(57) ABSTRACT

Because the PCV channel for guiding blow-by gas to a plenum is formed in an intake manifold, the blow-by gas can be equally supplied to respective combustion chambers. In addition, since a PCV nipple is mounted on the outermost intake runner that has a relatively high temperature, freezing of water vapor in the blow-by gas can be prevented in the PCV nipple.

3 Claims, 4 Drawing Sheets

AIR INTAKE SYSTEM FOR A VEHICLE

CROSS-REFERENCE TO RELATED APPLICATIONS

This application claims priority of Korean Application No. 10-2004-0052440, filed Jul. 6, 2004, the disclosure of which is incorporated herein by reference.

FIELD OF THE INVENTION

Generally, the present invention relates to an air intake system for a vehicle. More particularly, the present invention relates to an air intake system for a vehicle that prevents freezing in a positive crankcase ventilation (PCV) valve and a PCV nipple of the intake system.

BACKGROUND OF THE INVENTION

Generally, an internal combustion engine is an apparatus for generating power by burning fuel mixed with intake air in a combustion chamber. In an internal combustion engine, a small amount of gas (which is called blow-by gas) leaks from a combustion chamber into a crankcase. Because the blow-by gas is a factor for air pollution, the blow-by gas is controlled to return to the combustion chamber for re-burning.

A system provided to an engine for such re-burning of the blow-by gas is generally called a positive crankcase ventilation (PCV) system, and a system for supplying intake air to a cylinder is called an air intake system. In a typical PCV system, the blow-by gas is supplied first to a cylinder head from the crankcase through a passage formed in the cylinder block.

Subsequently, the blow-by gas is supplied to an intake manifold from the cylinder head consecutively through a PCV valve of the PCV system, a PCV hose, and a PCV nipple. Then the blow-by gas is supplied to the combustion chamber from the intake manifold through intake runners.

But, because water vapor is usually present in the blow-by gas, the vapor condenses into water, so water may freeze in the PCV nipple or the PCV valve of the PCV system after being gathered there. To prevent freezing in a PCV nipple or a PCV valve, the PCV nipple connected to a PCV hose may be mounted to an intake runner of an intake manifold. When the PCV hose is connected to the intake runner, the freezing in the PCV nipple can be prevented by the heat produced from the engine.

But in this system, because the blow-by gas from the PCV nipple is supplied only to a specific combustion chamber through a specific intake runner, the supply of the blow-by gas becomes biased to the specific cylinder, resulting in non-uniform supply of the blow-by gas to the combustion chambers.

The information disclosed in this section is only for enhanced understanding of the background of the invention and should not be taken as an acknowledgement or any form of suggestion that this information forms the prior art that is already known to a person of ordinary skill in the art.

SUMMARY OF THE INVENTION

The motivation for the present invention is to provide an air intake system for a vehicle having non-limiting advantages of preventing freezing in the air intake system and of supplying blow-by gas equally to cylinders.

An exemplary air intake system for a vehicle according to an embodiment of the present invention includes a plenum forming a plenum chamber for storing intake air temporarily, an intake manifold connected to the plenum and including a plurality of intake runners for guiding the intake air in a plenum chamber to a combustion chamber, and a positive crankcase ventilation (PCV) hose connecting a cylinder head cover to the intake manifold, wherein a PCV channel for connecting the PCV hose to the plenum chamber is formed in the intake manifold such that blow-by gas supplied through the PCV hose flows to the plenum.

In a further embodiment, an air intake system for a vehicle according to an embodiment of the present invention includes a PCV nipple connected to the PCV channel that is mounted in an outermost intake runner of a plurality of intake runners of the intake manifold, and the PCV hose is connected to the PCV nipple.

In another further embodiment, an air intake system for a vehicle according to an embodiment of the present invention includes the PCV channel for interconnecting the PCV hose and the plenum chamber protrudes from the intake manifold into the plenum with the PCV channel formed integrally with the intake manifold.

In another further embodiment, an air intake system for a vehicle according to an embodiment of the present invention includes that the PCV channel is formed at an angle toward a lower direction such that the blow-by gas is supplied to the plenum chamber at the angled direction.

In another further embodiment, an air intake system for a vehicle according to an embodiment of the present invention includes a pad for maintaining heat that is mounted around the outside of the PCV hose such that freezing of the blow-by gas is prevented in the PCV hose when the blow-by gas passes through.

BRIEF DESCRIPTION OF THE DRAWINGS

The accompanying drawings illustrate exemplary embodiments of the invention, and, together with the description, serve to explain the principles of the present invention, wherein.

DETAILED DESCRIPTION OF THE EMBODIMENTS

Generally, the present invention relates to an air intake system for a vehicle. More specifically, the present invention provides an air intake system that prevents freezing in areas in the positive crankcase ventilation. The following text in connection with the Figures describes various embodiments of the present invention. The following description, however, is not intended to limit the scope of the present invention. It should be appreciated that where the same numbers are in different Figures, these refer to the same element or structure.

Figure 1:
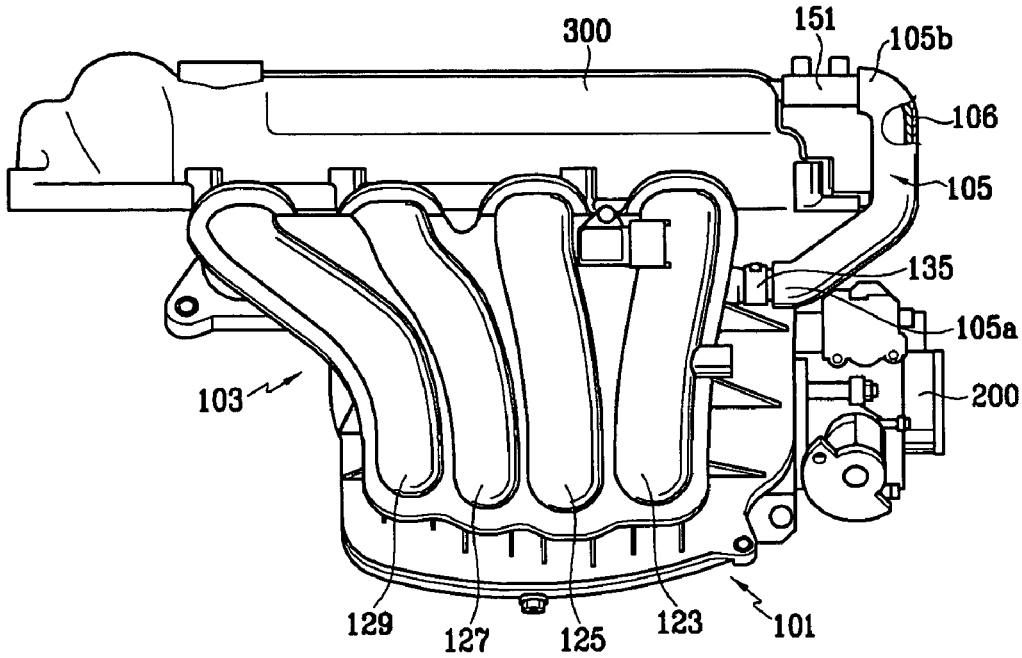
FIG. 1 is a perspective view showing an air intake system according to an embodiment of the present invention.
Figure 2:
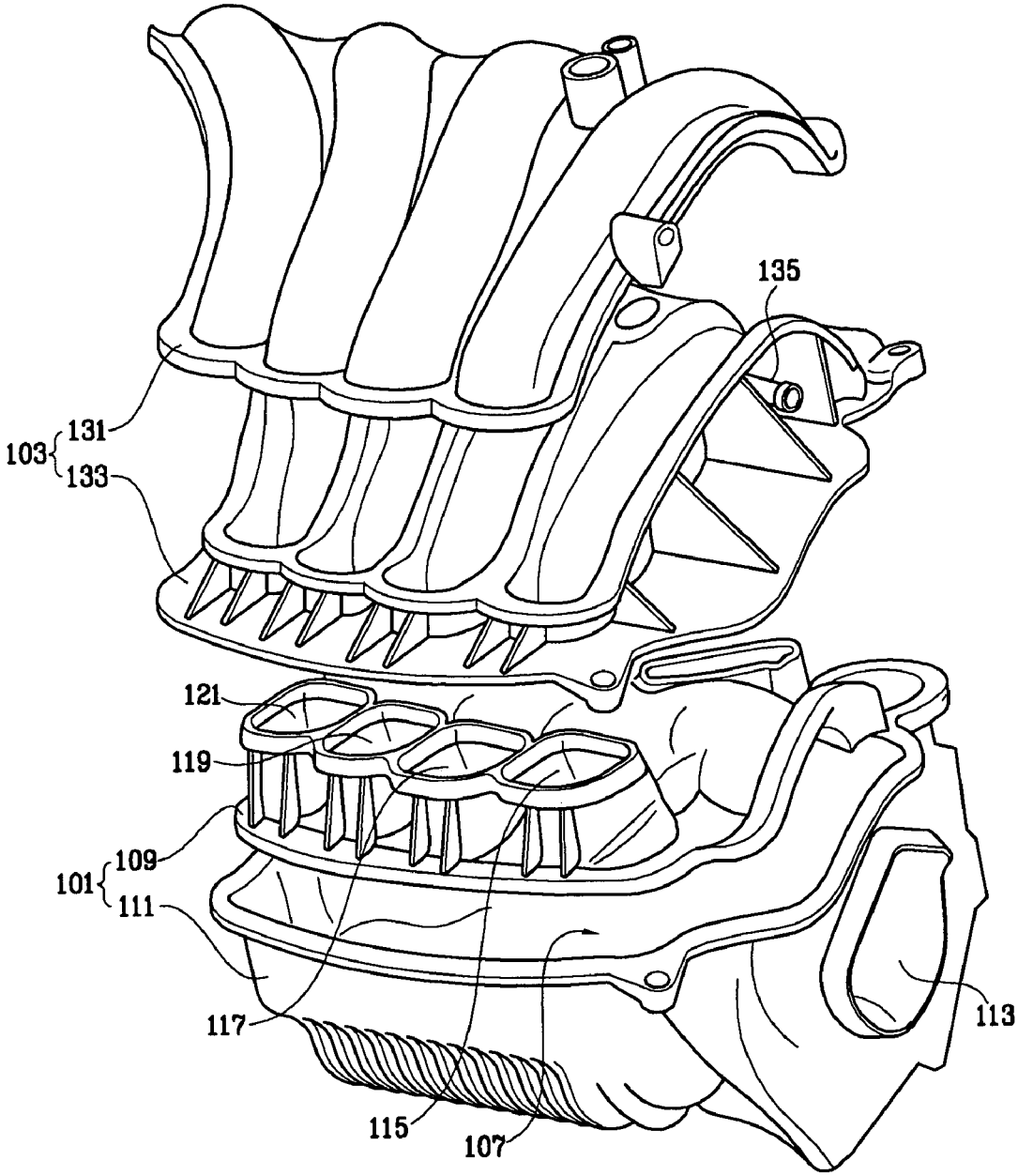
FIG. 2 is an exploded perspective view showing an intake manifold and a plenum of the air intake system according to an embodiment of the present invention.

FIG. 1 is a perspective view showing an air intake system, and FIG. 2 is an exploded perspective view showing an intake manifold and a plenum of the air intake system according to an embodiment of the present invention. As shown in FIG. 1 and FIG. 2, an air intake system of an internal combustion engine according to an embodiment of the present invention includes a plenum 101, an intake manifold 103, and a positive crankcase ventilation (PCV) hose 105. The plenum 101 forms a plenum chamber 107 for storing intake air temporarily. The intake manifold 103 is connected with a throttle body 200 by the plenum 101. That is, the plenum 101 is connected to a downstream side of the throttle body 200, and the intake manifold 103 is connected to a downstream side of the plenum 101. The intake air that has passed through the throttle body 200 is temporarily stored in the plenum 101 and is then supplied to a combustion chamber through the intake manifold 103.

As shown in FIG. 2, for example, the plenum 101 may be formed by a combination of an upper member 109 and a lower member 111. The plenum 101 is formed by attaching the upper member 109 and the lower member 111 together, and the plenum chamber 107 for temporarily storing the intake air is formed between the upper member 109 and the lower member 111 by such an attachment. Even though the plenum 101 is formed by the combination of two members according to an embodiment of the present invention, the plenum 101 also can be formed as one integral body. A passage 113 communicating with the throttle body 200 is formed in the lower member 111, and a plurality of air passages 115, 117, 119, and 121 are formed in the upper portion 109. The intake manifold 103 is connected to the plenum 101, and it includes a plurality of intake runners 123, 125, 127, and 129 for guiding the intake air in the plenum chamber 107 to the combustion chamber.

Also shown in FIG. 2, for example, the intake manifold may be formed by a combination of an upper member 131 and a lower member 133. The plurality of intake runners 123, 125, 127, and 129 of the intake manifold 103 are formed by attaching the upper member 131 and the lower member 133 together. Even though the intake manifold 103 is formed by the combination of two members according to an embodiment of the present invention, the intake manifold also can be formed as one member. The plurality of the intake runner 123, 125, 127, and 129 are respectively connected to the plurality of air passages 115, 117, 119, and 121 of the upper member 109 of the plenum 101.

A cylinder head cover 300 is connected with the intake manifold 103 by the PCV hose 105. A PCV valve 151 for regulating the flow of blow-by gas is mounted in a predetermined location of the PCV hose 105.

As shown in FIGS. 1 and 2, a PCV nipple 135 connected with the PCV hose 105 is mounted on the intake manifold 103. One end 105*a* of the PCV hose 105 is connected to the PCV nipple 135 and another end 105*b* of the PCV hose 105 is connected to the cylinder head cover 300 through the PCV valve 151.

Figure 3:
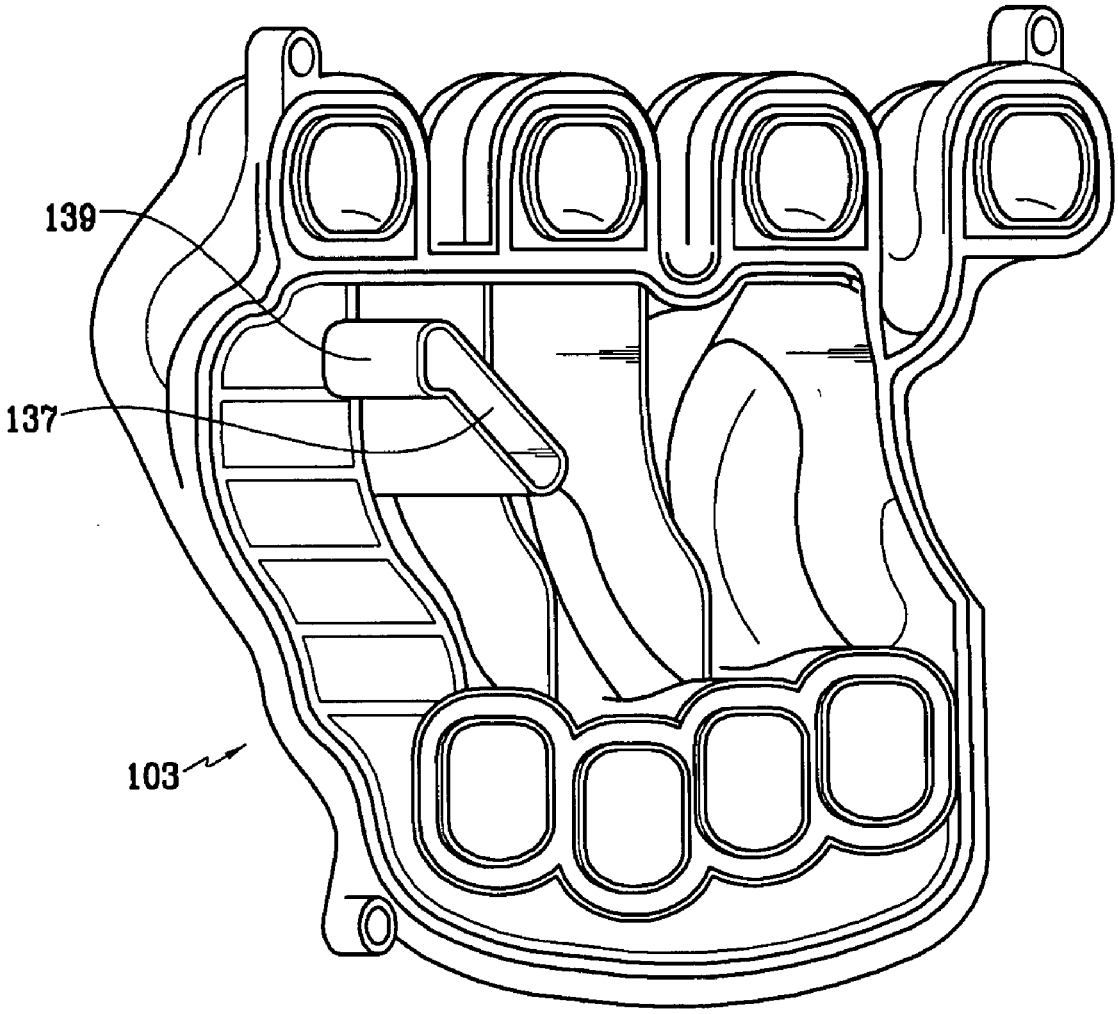
FIG. 3 is a perspective view showing a lower side of the intake manifold of the air intake system according to an embodiment of the present invention.

In FIG. 3, the PCV channel 137 for interconnecting the PCV hose 105 and the plenum chamber 107 is integrally formed with the intake manifold 103. More particularly, one end of the PCV channel 137 is connected to the PCV nipple 135 (not shown) and the other end thereof is connected to the plenum chamber 107 (not shown). Therefore, the blow-by gas that passes through the PCV hose 105 flows into the plenum chamber 107 through the PCV channel 137, and the PCV channel 137 is angled in a lower direction such that the blow-by gas is supplied to the plenum chamber 107 in the angled direction.

Also shown in FIG. 3, a PCV channel pipe 139 is formed in the intake manifold 103, and the PCV channel pipe 139 extends in a downward direction from the intake manifold 103.

Figure 4:
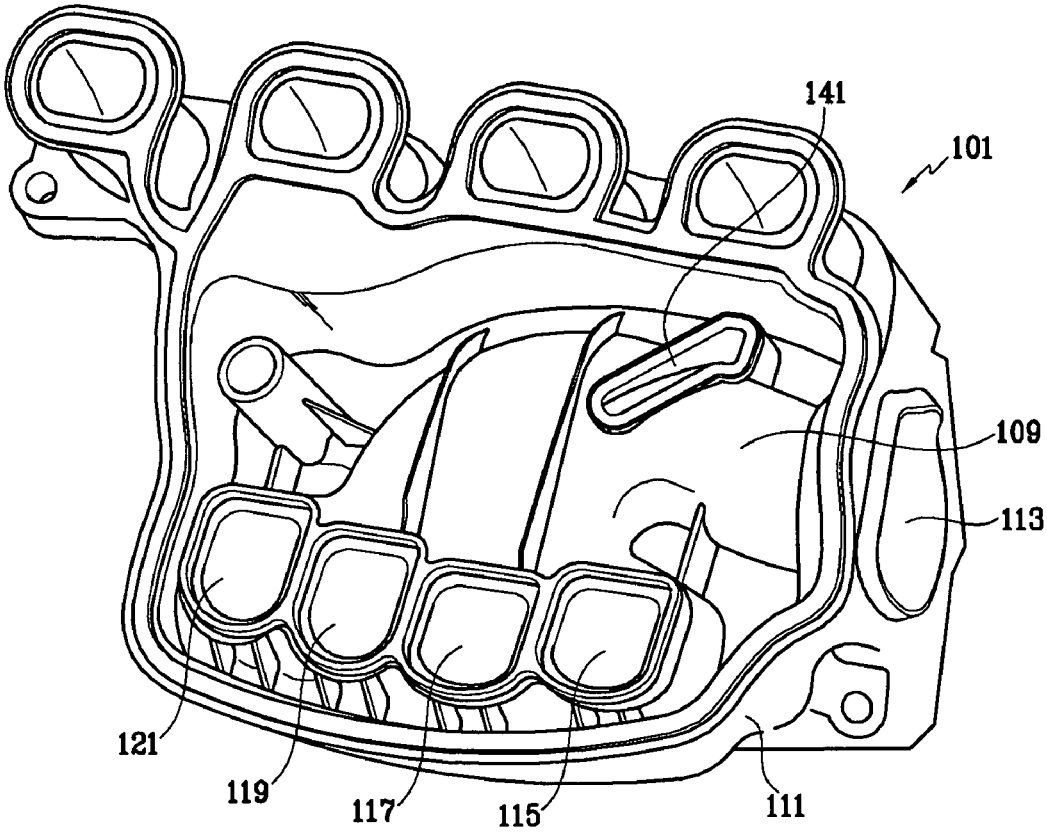
FIG. 4 is a perspective view showing a plenum of the air intake system according to an embodiment of the present invention.

Also shown in FIG. 4, an insertion hole 141 for inserting the PCV channel pipe 139 is located along the upper member 109 of the plenum 101.

In addition, the PCV channel 137 protrudes from the intake manifold 103 into the plenum 101, and is connected to the plenum 101 through the insertion hole 141. Therefore, the blow-by gas that passes through the PCV hose 105 flows into the plenum 101 through the PCV channel 137, and then, after the blow-by gas is mixed with the intake air, the blow-by gas is supplied to the combustion chamber through the plurality of the intake runners 123, 125, 127, and 129.

Because the blow-by gas is supplied to the respective combustion chambers after it is mixed with the intake air in the plenum 101, the blow-by gas can be supplied equally to the respective combustion chambers. Further, since the PCV channel 137 is formed integrally with the intake manifold 103, the blow-by gas is supplied equally to the respective combustion chambers by a more simple structure.

As shown in FIGS. 1 and 2, the PCV nipple 135 is preferably mounted on an outermost intake runner 123 of the intake manifold. More particularly, among the two outer intake runners 123 and 129, the outer intake runner 123 mounted on the PCV nipple 135 is the intake runner that is closest to the PCV valve 151.

Because the outermost intake runner 123 of the plurality of intake runners 123, 125, 127, and 129 is in a location closest to the engine (more particularly, the cylinder head or cylinder block), that is, the outermost intake runner 123 is in a location most directly exposed to the heat of the engine, the temperature in the outer intake runner 123 is relatively higher than the other intake runners 125, 127, and 129. Therefore, the freezing of water vapor in the blow-by gas is prevented in the PCV nipple 135, because the PCV nipple 135 is mounted on the outer intake runner 123.

Additionally, because the PCV nipple 135 is mounted on the intake runner 123 that is closest to the PCV valve 151 among the two outer intake runners 123 and 129, the PCV hose 105 is shorter than the case in which the PCV nipple 135 is directly mounted in the plenum 101. This design also simplifies the manufacturing process and improves the layout of the PCV hose 105.

Also as shown in FIGS. 1 and 3, the plenum 101 is mounted lower than the PCV valve 151 and the PCV nipple 135. As shown in the cutaway portion of FIG. 1, a pad 106 for maintaining heat is mounted inside the PCV hose 105 such that freezing of the blow-by gas is prevented in the PCV hose 105 when blow-by gas passes through.

According to an embodiment of the present invention, the air intake system can prevent freezing in the PCV nipple by low temperature intake air while traveling in low temperature circumstances, and the system can prevent freezing of water vapor remaining in the PCV valve. Because the PCV channel for guiding the blow-by gas to the plenum is formed in the intake manifold and the blow-by gas that passes through the PCV hose is uniformly mixed with the intake air and is then supplied to the combustion chambers, the blow-by gas can be supplied equally to the respective combustion chambers. In addition, because the PCV nipple is mounted on the outermost intake runner that has a relatively higher temperature, freezing of the water vapor in the blow-by gas can be prevented in the PCV nipple.

While the foregoing description represent various embodiments of the present invention, it will be appreciated that the foregoing description should not be deemed limiting since additions, variations, modifications and substitutions may be made without departing from the spirit and scope of the present invention. It will be clear to one of skill in the art that the present invention may be embodied in other forms, structures, arrangements, and proportions and may use other elements, materials and components. The present disclosed embodiments are, therefore, to be considered in all respects as illustrative and not restrictive, the scope of the invention being indicated by the appended claims and not limited to the foregoing description.

What is claimed is:

1. An air intake system comprising:

a plenum forming a plenum chamber for storing intake air temporarily;

an intake manifold connected to the plenum and including a plurality of intake runners for guiding the intake air in the plenum chamber to a combustion chamber: and a positive crankcase ventilation (PCV) hose connecting a cylinder head cover to the intake manifold, wherein a PCV channel for connecting the PCV hose to the plenum chamber is formed in the intake manifold such that blow-by gas supplied through the PCV hose flows to the plenum and wherein a PCV nipple connected to the PCV channel is mounted in an outermost intake runner of a plurality of intake runners of the intake manifold and the PCV hose is connected to the PCV nipple.

2. An air intake system comprising:

a plenum forming a plenum chamber for storing intake air temporarily;

an intake manifold connected to the plenum and including a plurality of intake runners for guiding the intake air in the plenum chamber to a combustion chamber; and a positive crankcase ventilation (PCV) hose connecting a cylinder head cover to the intake manifold, wherein a PCV channel for connecting the PCV hose to the plenum chamber is formed in the intake manifold such that blow-by gas supplied through the PCV hose flows to the plenum and wherein the PCV channel for interconnecting the PCV hose and the plenum chamber protrudes from the intake manifold into the plenum, and the PCV channel is formed integrally with the intake manifold.

3. The system of claim 2, wherein the PCV channel is formed at an angle toward a lower direction such that the blow-by gas is supplied to the plenum chamber at an angled direction.

* * * * *